US005252889A

United States Patent [19]

Choi

[11] Patent Number: 5,252,889

[45] Date of Patent: Oct. 12, 1993

[54] COLOR CRT WITH MEANS FOR CORRECTING MISLANDING OF ELECTRON BEAMS

[75] Inventor: Woong B. Choi, Seoul, Rep. of Korea

[73] Assignee: GoldStar Co., Ltd., Rep. of Korea

[21] Appl. No.: 799,250

[22] Filed: Nov. 27, 1991

[30] Foreign Application Priority Data

Nov. 29, 1990 [KR] Rep. of Korea ..... 90-18517

[51] Int. Cl.[5] ..... H01J 29/07

[52] U.S. Cl. ..... 313/404; 313/405; 313/407

[58] Field of Search ..... 313/405, 407, 404

[56] References Cited

U.S. PATENT DOCUMENTS 4,565,945 1/1986 Pawlikowski et al. ..... 313/407 X
4,638,211 1/1987 Fonda ..... 313/405
5,063,325 11/1991 Ragland, Jr. ..... 313/405

FOREIGN PATENT DOCUMENTS 2713246 10/1978 Fed. Rep. of Germany ..... 313/405
859 1/1979 Japan ..... 313/405

*Primary Examiner*—Palmer C. Demeo
*Attorney, Agent, or Firm*—Morgan & Finnegan

[57] ABSTRACT

A color CRT with a first bimetal correction means provided between the inner wall of the screen panel and the shadow mask for correcting the mislanding of the electron beams due to the thermal expansion of the shadow mask, and a second bimetal correction means provided between the lower end portion of the skirt of the shadow mask and the inner wall of the mask frame for quickly correcting the initial doming of the shadow mask, thereby correcting the mislanding occurring in the beginning stage of operating the color CRT.

2 Claims, 2 Drawing Sheets

COLOR CRT WITH MEANS FOR CORRECTING MISLANDING OF ELECTRON BEAMS

FIELD OF THE INVENTION

This invention relates to a means to correct a mislanding during the initial heating of the shadow mask of a color CRT.

TECHNICAL BACKGROUND OF THE INVENTION

Generally a conventional color CRT comprises a screen panel 21, a fluorescent layer 24 formed on the inner side of the screen panel, an electron gun 26 and a shadow mask 25 installed between the electron gun and the fluorescent layer. The shadow mask is supported on the mask frame together with an earth magnetic field shield, a resilient member 22, etc.

The shadow mask 25 has several hundred thousand electron apertures whose total area is less than one third of the effective area of the shadow mask. About two thirds of the electrons emitted from the electron gun 26 do not pass through the apertures and strike blocked area around the apertures to heat the shadow mask 25 to a temperature of more than about 80° C. Consequently, the shadow mask 25 undergoes a thermal expansion causing the central part to bow towards the fluorescent layer 24, which bowing phenomena is generally referred to as doming, so that the normal position of the apertures of the shadow mask 25 deviates. For this reason, the electrons emitted from the electron gun 26 pass through the apertures of the distorted position mislanding on incorrect spots of the fluorescent layer 24. As a result the images are overlapped together on the screen resulting in unclear pictures.

Therefore, as disclosed in Japanese Patent Publication No. 44-3547, the conventional color CRT is provided with a bimetal between the inner wall of the screen panel 21 and the outer wall of the mask frame 27 to maintain the distance between the shadow mask 25 and fluorescent layer 24 within a given range. FIG. 2 shows that the mislanding due to doming of the shadow mask 25 is being corrected by such a bimetal.

In this case, the first interval indicates the extent of mislanding owing to the position of the apertures deviated by the heating of the shadow mask 25, and the second interval indicates the mislanding extent is compensated by the bimetal. In FIG. 3 and 4, the position of the shadow mask 25 at the turning-on point (t=0) of the color CRT is 5*a* and the deviated position owing to the increasing temperature of the shadow mask 25 is 5*b* in the first interval. Accordingly the route of an electron beam passing an aperture of the shadow mask 25 is changed from C1 to C2. As a result, the electron beam is mislanded on the fluorescent layer 24 by the extent of $\Delta x$. Such a mislanding is compensated by the thermal expansion of a bimetal by the heat transferred from the shadow mask 25 through the mask frame 27. Since this compensation occurs after the time t=T as shown in FIG. 2, the conventional method of using a bimetal takes a long compensation time.

SUMMARY OF THE INVENTION

The object of this invention is to provide a means to more rapidly correct a mislanding due to the doming of the shadow mask in the beginning stage of operating a color CRT.

A color CRT of this invention comprises a first bimetal correction means provided between the inner wall of the screen panel and the outside wall of the frame for correcting the mislanding of the electron beam due to the thermal expansion of the shadow mask 25, and a second correction means provided between the lower end portion of the skirt of the shadow mask 25 and the inner wall of the mask frame 27 for quickly correcting the initial doming the shadow mask; thereby correcting the mislanding occurring in the beginning stage of operating the color CRT. Thus the compensation of the mislanding according to the present invention is achieved in two steps: first by the first correction means and second by the second correction means 1.

The present invention will now be described more specifically with reference to the drawings attached only by way of example.

DETAILED DESCRIPTION OF THE INVENTION

Figure 1:
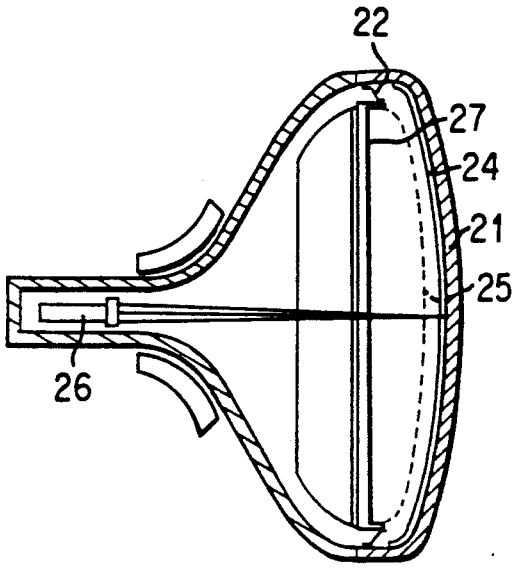
FIG. 1 is a schematic sectional view of a color CRT.
Figure 2:
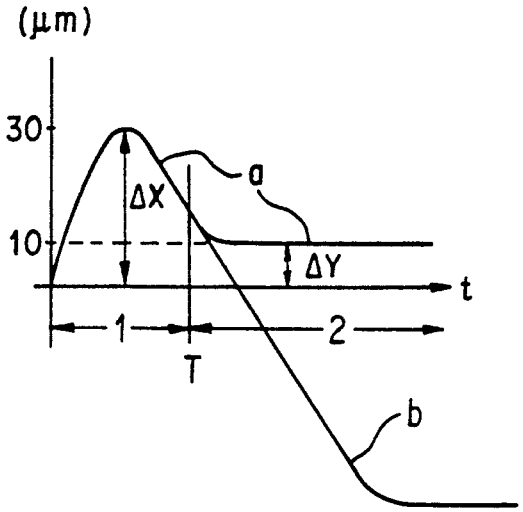
FIG. 2 shows the mislanding of electron beams caused by the doming of the shadow mask of FIG. 1 and the correction thereof.
Figure 3:
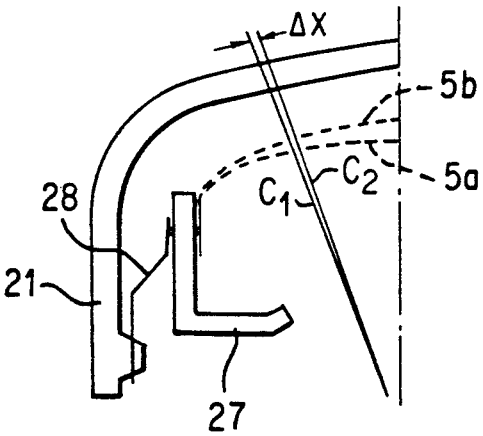
FIG. 3 and FIG. 4 show the essential part of the conventional means for correcting the mislanding by a bimetal in connection with FIG. 1.
Figure 4:
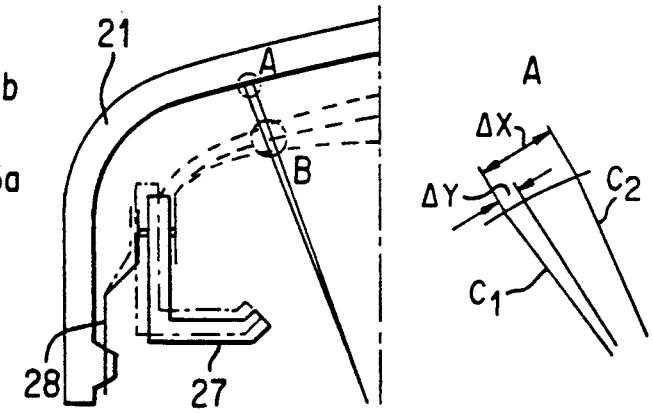
Figure 5:
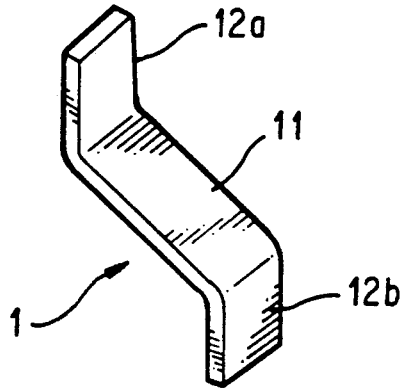
FIG. 5 is an enlarged perspective view of a mislanding correction unit according to this invention.

As shown in FIG. 5, a mislanding correction unit 1 is a metal member comprising an inclined central plane portion 11, and a pair of flat parallel tips 12*a* and 12*b* respectively and oppositely extended from both ends of the central plane portion 11. Namely, both end portions of a metal strip are oppositely bent in parallel at a dull angle to form the parallel flat tips 12*a* and 12*b*. The thermal expansion coefficient of the metal member forming the mislanding correction unit 1 is at least greater than that of the shadow mask 25.

The flat tips 12*a* and 12*b* are respectively and closely fixed to the outside wall of the skirt of the shadow mask 25 and the inner wall of the mask frame 27.

Hereinafter, the operation and effect of the inventive mislanding correction unit will be described.

The mislanding correction unit of this invention 1 receives heat through the skirt of the shadow mask 25 in the beginning stage of operating the color CRT because it is provided between the outside wall of the skirt of the shadow mask and the inner wall of the mask frame 27. At this time, the mislanding correction unit 1 moves in the direction of d2 by the extent U as shown in FIG. 7B due to the difference between two thermal expansion forces because of the thermal expansion coefficient of the mislanding correction unit 1 being greater than that of the skirt of the shadow mask.

Figure 6:
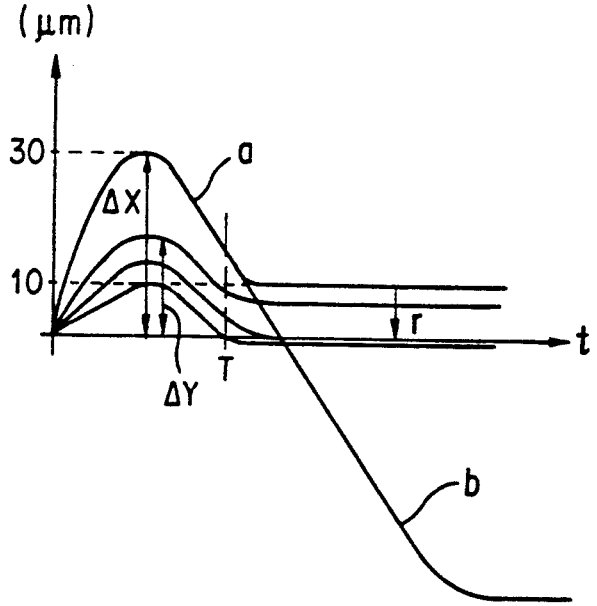
FIG. 6 shows the curves for illustrating the working effect of the shadow mask with the mislanding correction unit.
Figure 7A:
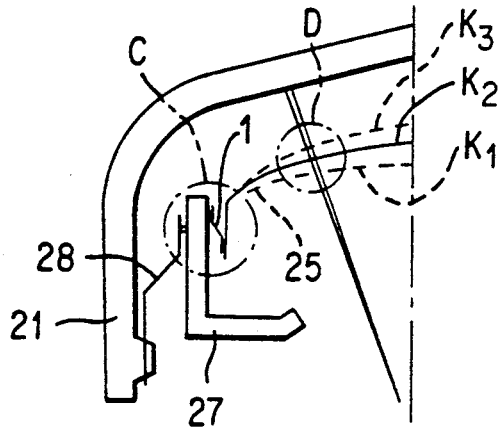
FIG. 7A is a schematic diagram for showing the working of the shadow mask with the mislanding correction unit.
Figure 7C:
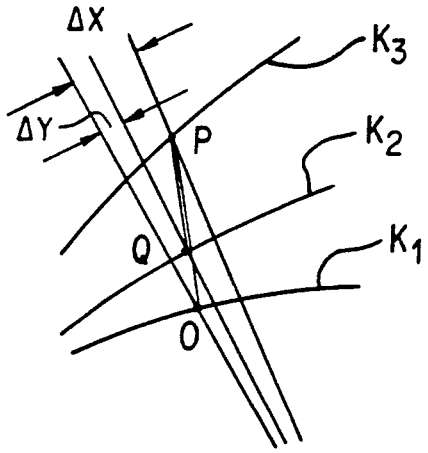
FIG. 7C is an enlarged view of the part 'D' of FIG. 7A.
Figure 7B:
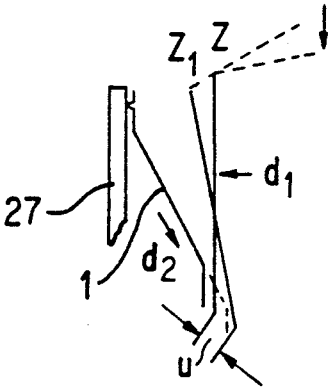
FIG. 7B is an enlarged view of the part 'C' of FIG. 7A.

Accordingly the surface of the shadow mask (25) is moved towards the electron gun 26 taking the position indicated by K2 in FIG. 7C, which position is near the original normal position. Namely, when the color CRT is turned on, the shadow mask initially moves from the aperture position 'O' of the initial state K1 to the aperture position 'P' of the state K3 due to the thermal expansion, and then is moved to the aperture position 'Q' of the state K2 by the compensation of the mislanding correction unit 1. Therefore the size of the mislanding is reduced from the initial value $\Delta x$ to $\Delta y$ as shown in FIG. 6 (the first compensation).

Further, the size of mislanding moves in the direction of arrow (r) in the second interval (after $t=T$) as shown in FIG. 6 by the conventional bimetal provided between the screen panel and the mask frame. Consequently there may be obtained a color CRT wherein the mislanding is almost completely compensated by adjusting the thermal expansion coefficients of the mislanding correction unit 1 and bimetal 28.

Figure 8:
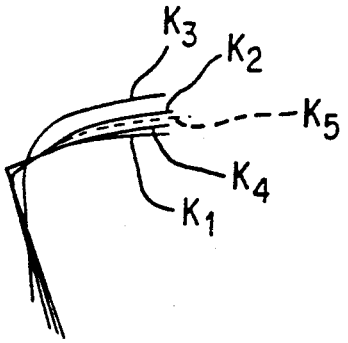
FIG. 8 is a schematic diagram for illustrating the changing states of the position of the shadow mask in a color CRT according to the present invention.

FIG. 8 generally shows the operational states of the shadow mask with the inventive mislanding correction unit. The shadow mask 25 moves from the initial position K1 through K3 of the beginning stage of operation to K2 corrected by the mislanding correction unit 1 to K4 caused by the thermal expansion of the mask frame 27 to K5 compensated by the bimetal 28.

In conclusion, this invention consists of a mislanding correction unit provided between the inner wall of the mask frame and the outer wall of the skirt of the shadow mask in addition to the bimetal provided between the screen panel and the mask frame and has a thermal expansion coefficient greater than that of the skirt of the shadow mask, thus rapidly compensating the doming of the shadow mask.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims. The above reference is hereby incorporated by reference.

What is claimed is:

1. A color cathode-ray tube comprising a screen panel, a fluorescent layer adjacent to an inner wall of said screen panel, a shadow mask positioned between an electron gun of the cathode ray tube and the fluorescent layer and further including a means for correcting the mislanding of electron beams, said shadow mask, being supported on a mask frame, selectively passing the electron beams emitted from an electron gun to form beam spots;

said correcting means including: (1) a first correcting means positioned between the shadow mask frame and an inner sidewall of the screen panel for changing the position of said shadow mask by being thermally expanded due to the heat transferred from said shadow mask; and (2) a second correcting means positioned between a skirt of the shadow mask and the mask frame for compensating a deviated position of said shadow mask by being expanded due to the heat transferred thereto, wherein said second correcting means moves said shadow mask away from said fluorescent layer.

2. A color CRT according to claim 1, wherein said second correcting means has a greater thermal expansion coefficient than that of said shadow mask.

* * * * *